US008511685B2

(12) United States Patent
Goldman

(10) Patent No.: US 8,511,685 B2
(45) Date of Patent: Aug. 20, 2013

(54) STELLATED ICOSAHEDRON PUZZLE

(76) Inventor: Igor Goldman, Montgomery Village, MD (US)

( * ) Notice: Subject to any disclaimer, the term of this patent is extended or adjusted under 35 U.S.C. 154(b) by 155 days.

(21) Appl. No.: 13/224,248

(22) Filed: Sep. 1, 2011

(65) Prior Publication Data

US 2013/0056931 A1 Mar. 7, 2013

(51) Int. Cl.
*A63F 3/00* (2006.01)

(52) U.S. Cl.
USPC ..... 273/156; 273/153 R

(58) Field of Classification Search
USPC ..... 273/153 S, 153 R, 158, 159, 156; 446/108
See application file for complete search history.

(56) References Cited

U.S. PATENT DOCUMENTS

| | | | | |
|---|---|---|---|---|
| 4,529,201 | A * | 7/1985 | Nadel | 273/153 S |
| 4,593,908 | A * | 6/1986 | Ibrahim | 273/153 S |
| 4,719,726 | A * | 1/1988 | Bergman | 52/81.4 |
| 2005/0288082 | A1 * | 12/2005 | de la Huerga | 463/9 |
| 2009/0309302 | A1 * | 12/2009 | Langin-Hooper | 273/153 S |

* cited by examiner

*Primary Examiner* — Vishu K. Mendiratta

(57) ABSTRACT

A stellated icosahedron puzzle has a plurality of assembled together parts forming in an assembled condition a stellated icosahedron, the assemblies including six mated together hollow octahedron assemblies and twelve hollow pyramid assemblies located on the hollow octahedron assemblies rotatable around each of the octahedron assembly via pivot shafts of the octahedron assemblies and stoppable every 180° of rotation, and the pyramid assemblies being independently attachable to and detachable from each of the pivot shafts.

11 Claims, 17 Drawing Sheets

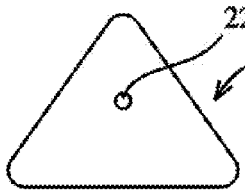
FIG. 6A
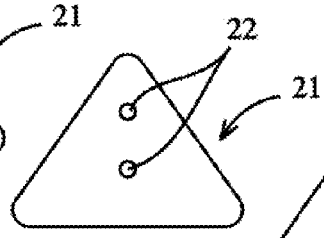
FIG. 6B
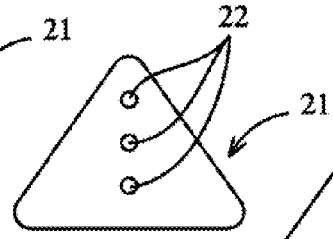
FIG. 6C
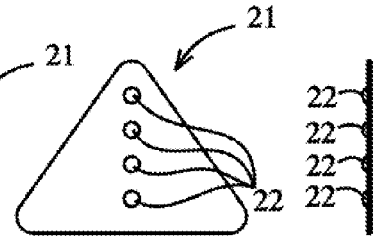
FIG. 6D
FIG. 6E
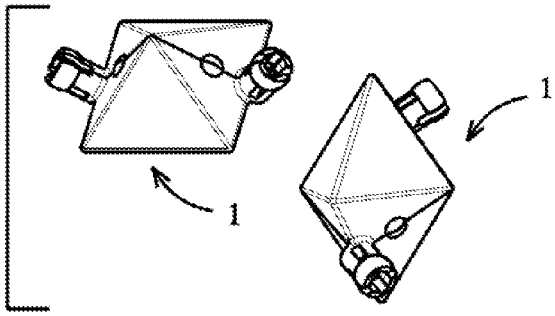
FIG. 7A
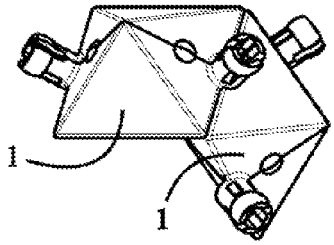
FIG. 7B
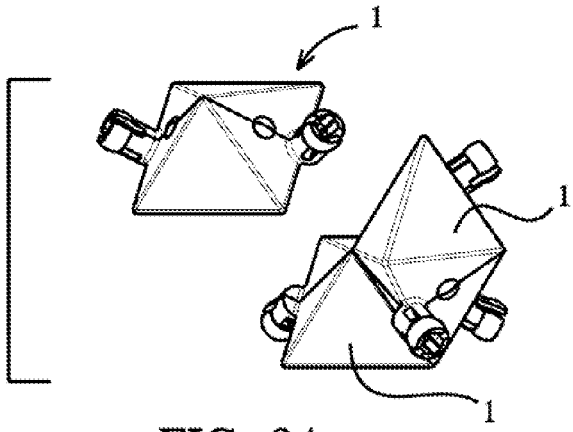
FIG. 8A
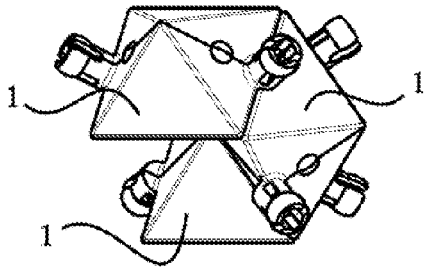
FIG. 8B

STELLATED ICOSAHEDRON PUZZLE

BACKGROUND OF THE INVENTION

The present invention relates to a multi-piece games or puzzles, which can be assembled from a plurality of pieces.

Numerous games or puzzles are designed and manufactured, and are currently in use. One of them is disclosed, for example, in patent document SU 1347959 A1.

It is believed that existing games or puzzles of this type can be further improved.

SUMMARY OF THE INVENTION

It is therefore an object of the present invention to provide a new puzzle composed of a plurality of pieces, which is a further improvement of the existing puzzles.

In keeping with these objects and with others which will become apparent hereinafter, one feature of the present invention resides, briefly stated, in a puzzle which is assembled of several parts, comprising a plurality of assemblies forming together in an assembled condition a stellated icosahedron, said assemblies including six mated together hollow octahedron assemblies and twelve hollow pyramid assemblies located on said hollow octahedron assemblies and rotatable around each of said octahedron assemblies via pivot shafts of said octahedron assemblies and stoppable every 180° of rotation, said pyramid assemblies being independently attachable to and detachable from each of said pivot shafts.

Another feature of the present invention resides in that each of said octahedron assemblies is composed of two identical hollow semi-octahedron parts.

A further feature of the present invention is that each of said hollow semi-octahedron parts has two halves of said hollow pivot shaft, symmetrically located on two top surfaces of said octahedron part and half-way protruding outwardly of the latter.

Each of said half of said hollow pivot shaft in said octahedron assembly can form a full said pivot shaft and has a top domed end with elasticity—imparting gaps to accommodate insertion of a respective one of said pyramid assemblies to provide a robust and easy attachment of the latter.

Each of said top surfaces of said octahedron part can have bumps providing stepping of said pyramid assembly every 180° of its rotation.

Each of said octahedron parts can have inside surfaces provided with pins and symmetrically located pin holes engaging with one another and ensuring a press-fit engagement of two of said octahedron parts into one of said octahedron assemblies.

Each of said pyramid assemblies can include two identical hollow semi-pyramid parts each having a cut with a domed top formed for said pivot shaft, and also on an inner surface protruding pins and symmetrically located pin holes ensuring a press-fit engagement of two said pyramid parts to form one of said pyramid assemblies.

Each of said pyramid parts can have on outside surfaces recesses for locating label inserts which are attached by one of pressing or gluing into the recess.

The said labels can have different elements selected from the group consisting of colors, numbers, and indexes.

The pyramid parts can have on an outside bottom surface two symmetrical cutouts interacting with said bumps of said octahedron assembly for fixing rotation of said pyramid assembly every 180° of rotation.

The octahedron part can have two bottom outside surfaces provided with grip provisions and one middle bottom outside surface with central u-groove provision for easy and secure attachments and detachments of octahedron assemblies with each other.

Still a further feature of the present invention is that each of said pyramid parts can have on its apex hollow semi-spheres with symmetrically located in pins on one side and pin holes on another side, so that said semi-spheres together form full spheres serving as handles for easy and convenient pyramid attachments to and detachments from octahedron surfaces.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6A is a front view of label insert with one index;

FIG. 6B is a front view of label insert with two indexes;

FIG. 6C is a front view of label insert with three indexes;

FIG. 6D is a front view of label insert with four indexes;

FIG. 6E is a right side view of label insert with four indexes on FIG. 6D;

FIG. 7A is an exploded perspective view of two octahedron assemblies coming together;

FIG. 7B is a perspective view of two octahedron assemblies on FIG. 7A mated together;

FIG. 8A is an exploded perspective view of three octahedron assemblies, two of them are mated together;

FIG. 8B is a perspective view of three octahedron assemblies on FIG. 8A mated together;

DESCRIPTION OF THE PREFERRED EMBODIMENTS

Figure 1:
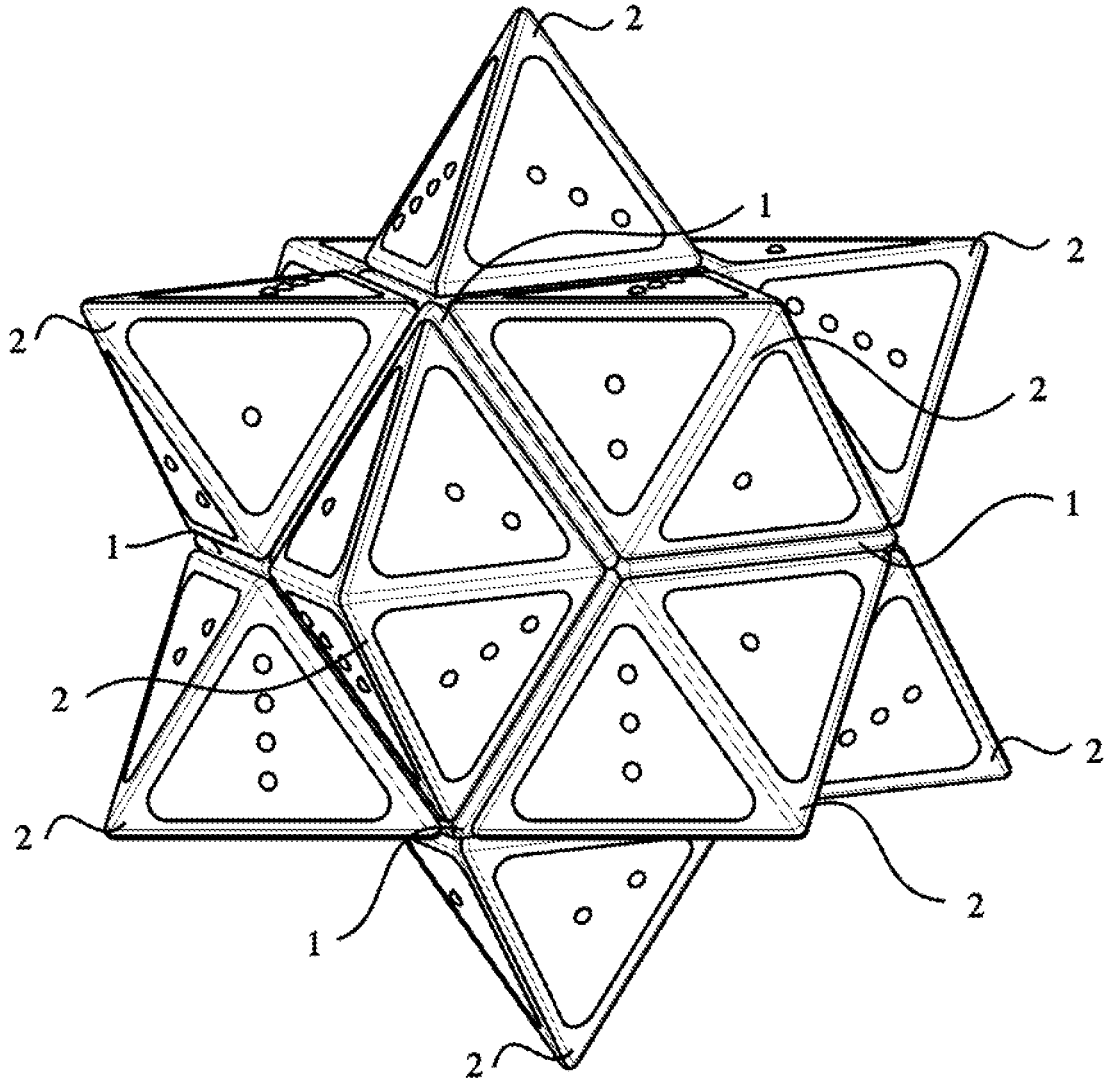
FIG. 1 is a view showing a stellated icosahedron puzzle in a perspective view in accordance with the present invention.

A stellated icosahedron puzzle in accordance with the present invention as shown in FIGS. 1, 21, 23 and 31 has six mated together hollow octahedron assemblies 1, and twelve hollow pyramid assemblies 2, locating on six hollow octahedron assemblies 1 with possibilities to be rotated around each of two octahedron assembly pivot shafts 3 with precise and firm position stops every 180 degree of rotation and to be independently attached from and detached to each pivot shaft 3.

Each octahedron assembly 1 is formed by two identical hollow semi octahedron parts 4 shown in FIGS. 2, 3A, 3B, 24A, 25A.

Each of hollow semi octahedron part 4, shown on FIGS. 2, 3A-3F, has two halves of hollow pivot shaft 5, symmetrically located on two top surfaces 6 of octahedron part 4 and half way protruding outside of octahedron part 4.

Each half of hollow pivot shaft 5 forms in octahedron assembly full pivot shaft 3 shown on FIGS. 3B-3F and has top domed end 7 with small gaps 8, designed to make hollow pivot shaft 3 elastic to allow insertion of the pyramid assembly 2 with possibility to provide robust and easy pyramid assemblies attachments from and detachments to the puzzle.

On the top surfaces 6 bumps 9 are located, shown on FIGS. 2, 3A-3D. Bumps 9 provide precise and firm position stops every 180 degree of pyramid assembly rotation after insertion it into pivot shaft 5 of octahedron assembly 1.

Figure 2:
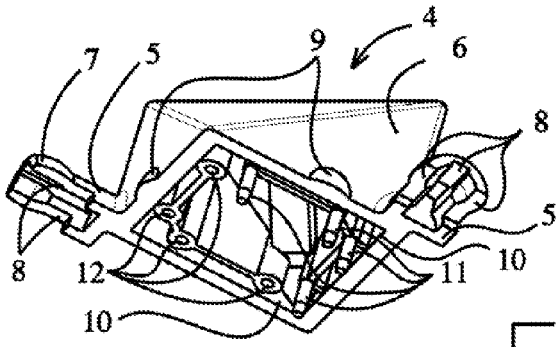
FIG. 2 is a perspective view of the octahedron part.
Figure 3A:
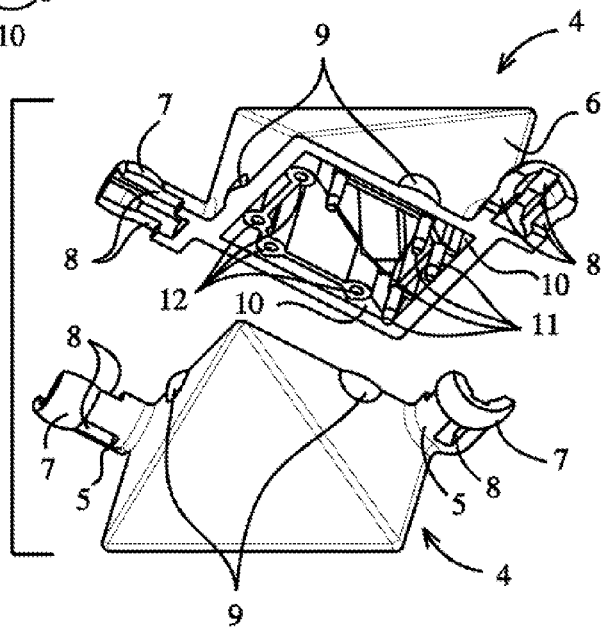
FIG. 3A is an exploded perspective view of the octahedron assembly.
Figure 3B:
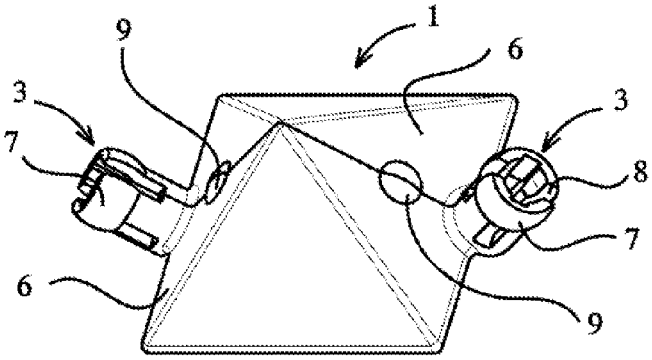
FIG. 3B is a perspective view of the octahedron assembly on FIG. 3A.
Figure 3C:
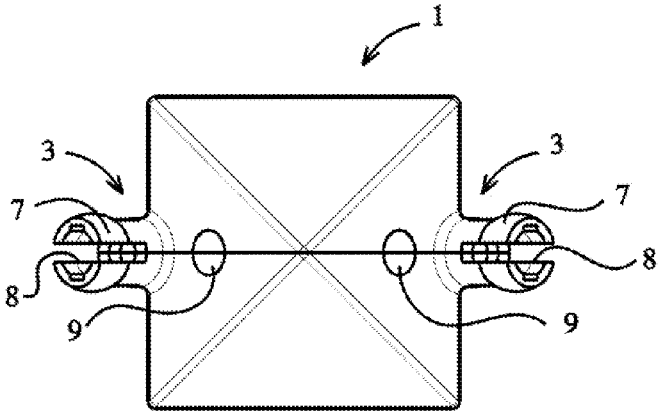
FIG. 3C is a top view of the octahedron assembly on FIG. 3B.
Figure 3D:
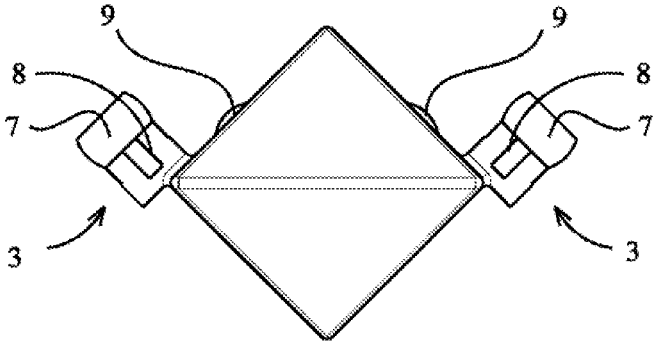
FIG. 3D is a front view of the octahedron assembly on FIG. 3C.
Figure 3E:
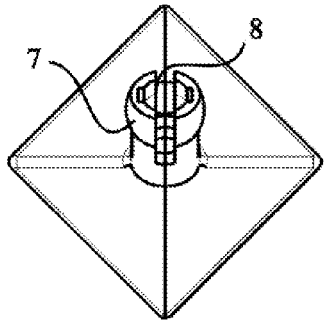
FIG. 3E is a right side view of the octahedron assembly on FIG. 3D.
Figure 3F:
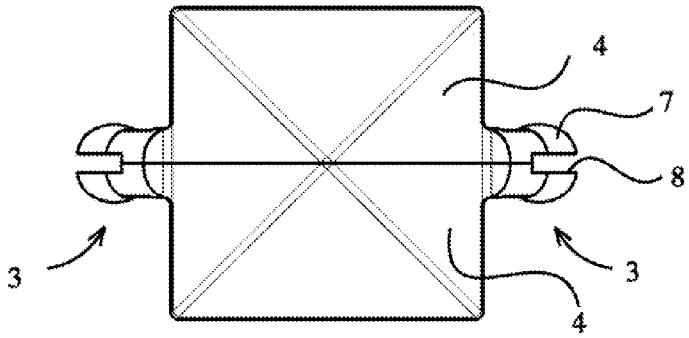
FIG. 3F is a bottom view of the octahedron assembly on FIG. 3D.

Each octahedron part 4 has on inside hollow surfaces 10 protruded pins 11 and symmetrically located pin holes 12 as shown on FIGS. 2 and 3A. Protruded pins 11 and pin holes 12 provide press fit engagement of two octahedron parts 4 to form and secure one octahedron assembly 1 as shown on FIGS. 3A, 3B, 25A and 25B.

Each pyramid assembly 2 is formed by two identical hollow semi pyramid parts 13 shown on FIGS. 4, 5A, FIGS. 5B, 26 and 27A.

Figure 4:
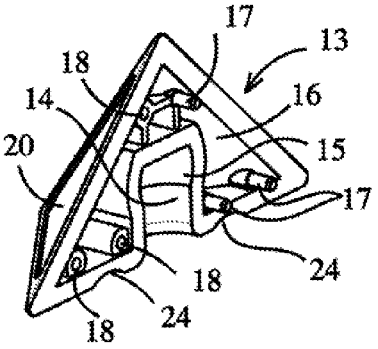
FIG. 4 is a perspective view of the pyramid part.
Figure 5A:
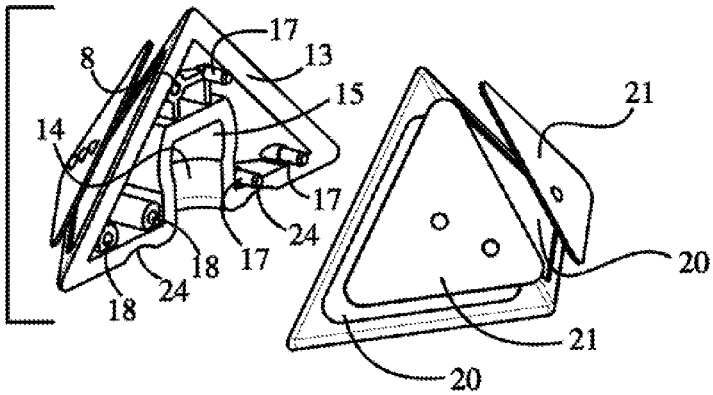
FIG. 5A is an exploded perspective view of the pyramid assembly with label inserts.

Each hollow pyramid part 13 has cutout 14 with domed top 15 shown on FIGS. 4 and 5A, formed for firm engagement with pivot shaft 5. Each pyramid part 13 has, on inside hollow surfaces 16, protruded pins 17 and symmetrically located pin holes 18 as shown on FIGS. 4 and 5A. Protruded pins 17 and pin holes 18 provide press fit engagement of two pyramid parts 13 to form and secure one pyramid assembly 2 as shown on FIGS. 5A, 5B, 27A and 27B.

Figure 5B:
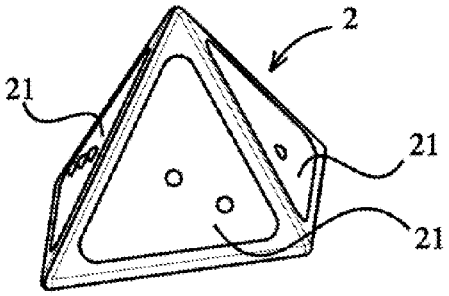
FIG. 5B is a perspective view of the pyramid assembly with label inserts on FIG. 5A.
Figure 5C:
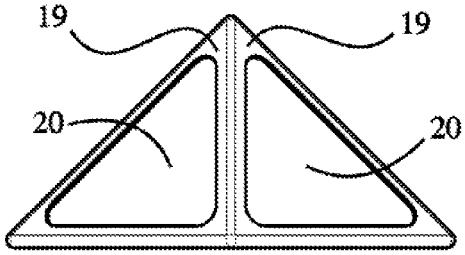
FIG. 5C is a front view of the pyramid assembly without label inserts.
Figure 5D:
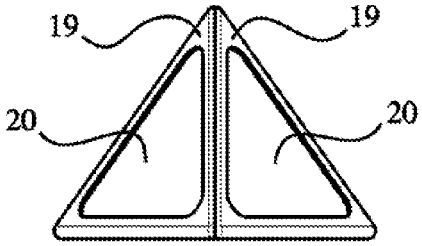
FIG. 5D is a right side view of the pyramid assembly without label inserts on FIG. 5C.

Outside surfaces 19 of pyramid part 13 have small recesses 20 as shown on FIGS. 5A-5D for locating label inserts 21 shown on FIGS. 5A and 5B. Label inserts 21 can be pressed or glued into recesses 20 as shown on FIG. 5A.

Label inserts 21 can have different colors, or numbers, or letters, or indexes 22 as shown on FIGS. 6A-6E. Indexes 22 are designed to identify similar by color or number, or letter surfaces on the pyramid assemblies 2. For example, surfaces with one index are identical to the surface with the same color, number or letter. Surfaces with two indexes are identical to different surface with different, from index one, another color, number or letter. Indexes 22 can be protruded or recessed. Protruded or recessed indexes 22 can help visually impaired people to play puzzle or simply play puzzle in a dark environment, which extends puzzle possibilities.

Figure 5E:
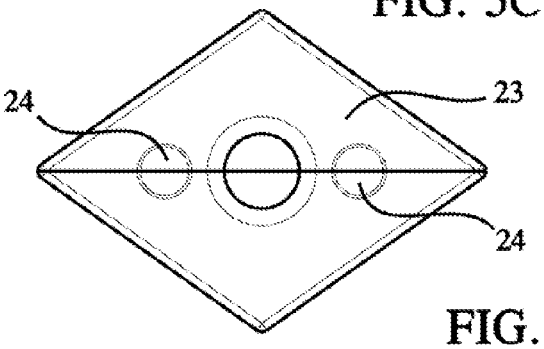
FIG. 5E is a bottom view of the pyramid assembly without label inserts on FIG. 5C.
Figure 9A:
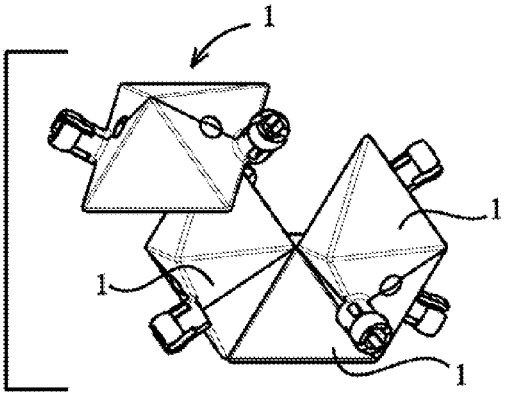
FIG. 9A is an exploded perspective view of four octahedron assemblies, three of them are mated together.
Figure 9B:
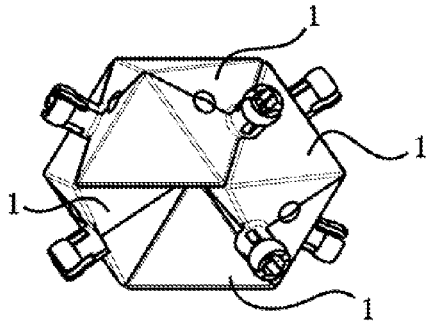
FIG. 9B is a perspective view of four octahedron assemblies on FIG. 9A mated together.
Figure 10A:
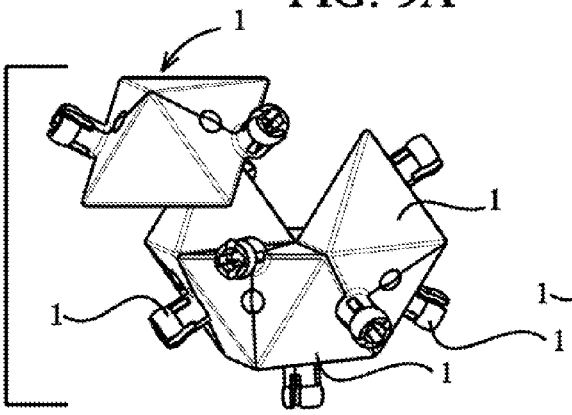
FIG. 10A is an exploded perspective view of five octahedron assemblies, four of them are mated together.
Figure 10B:
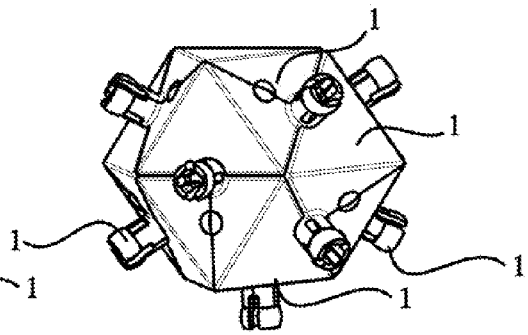
FIG. 10B is a perspective view of five octahedron assemblies on FIG. 10A mated together.
Figure 11A:
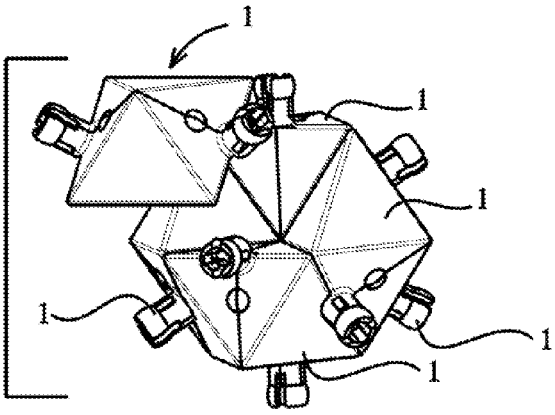
FIG. 11A is an exploded perspective view of six octahedron assemblies, five of them are mated together.
Figure 11B:
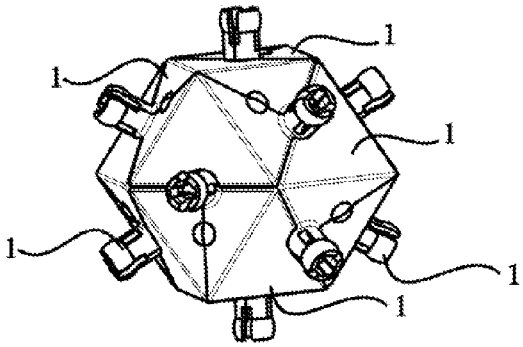
FIG. 11B is a perspective view of six octahedron assemblies on FIG. 11A mated together.

Outside surface 23 which is base bottom surface of pyramid part 13 has two symmetrical revolved cutouts 24 shown on FIGS. 4, 5A and 5E designed for interaction with bumps 9 on octahedron assemblies 1. This provides necessary position fix every 180 degree of rotation of pyramid assembly 2 on pivot shaft 3 of octahedron assembly 1.

On the bottom outside middle surface of the octahedron part 4 can be provided u-shaped groove formations 25, shown on FIGS. 24B, 24D, 24E, 25A-25C and 25E.

Figure 25A:
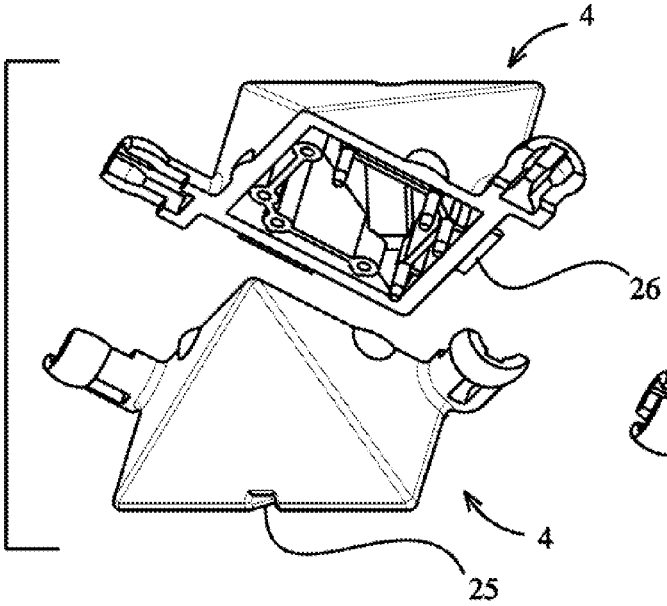
FIG. 25A is an exploded perspective view of the octahedron assembly showing grip and u-shaped groove provisions.
Figure 25B:
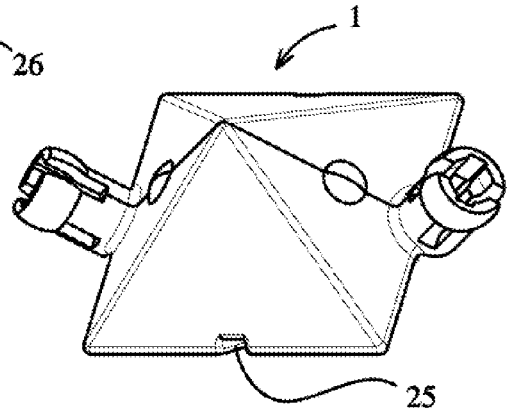
FIG. 25B is a perspective view of the octahedron assembly showing u-shaped groove provisions on FIG. 25A.
Figure 25C:
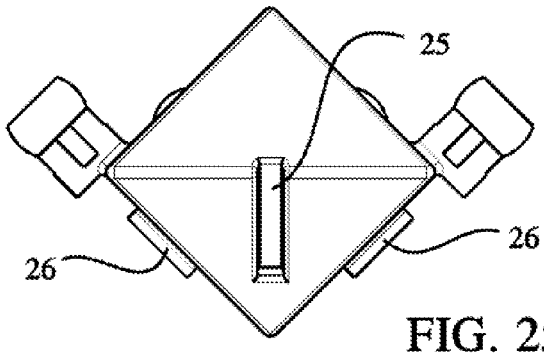
FIG. 25C is a front view of the octahedron assembly on FIG. 25B.
Figure 25D:
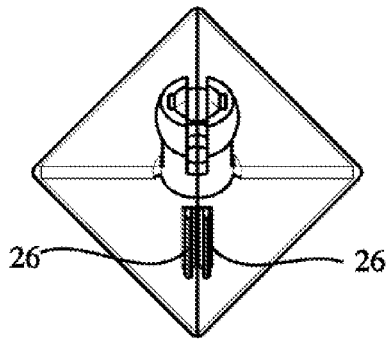
FIG. 25D is a right side view of the octahedron assembly on FIG. 25C.
Figure 25E:
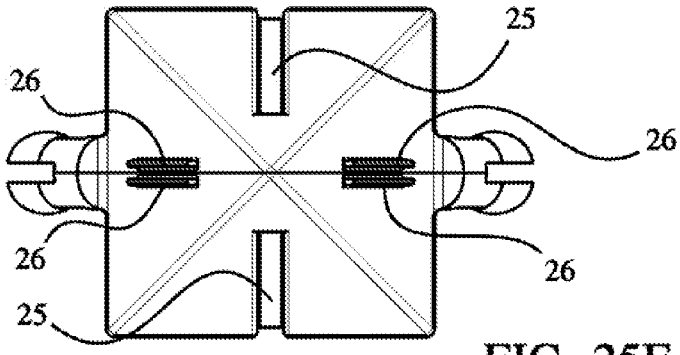
FIG. 25E is a bottom view of the octahedron assembly on FIG. 25C.

On the bottom outside opposite surfaces of the octahedron part 4 can be provided grip formations 26 shown on FIGS. 25C-25E.

Figure 30:
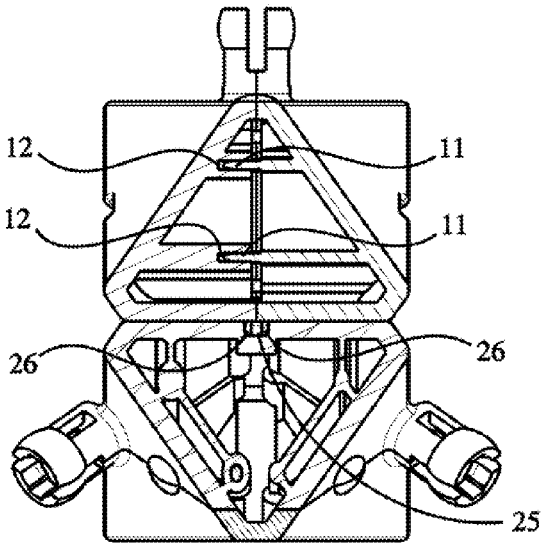
FIG. 30 is a sectional view of two octahedron assemblies with grip and u-shaped groove provisions on FIG. 29.
Figure 31:
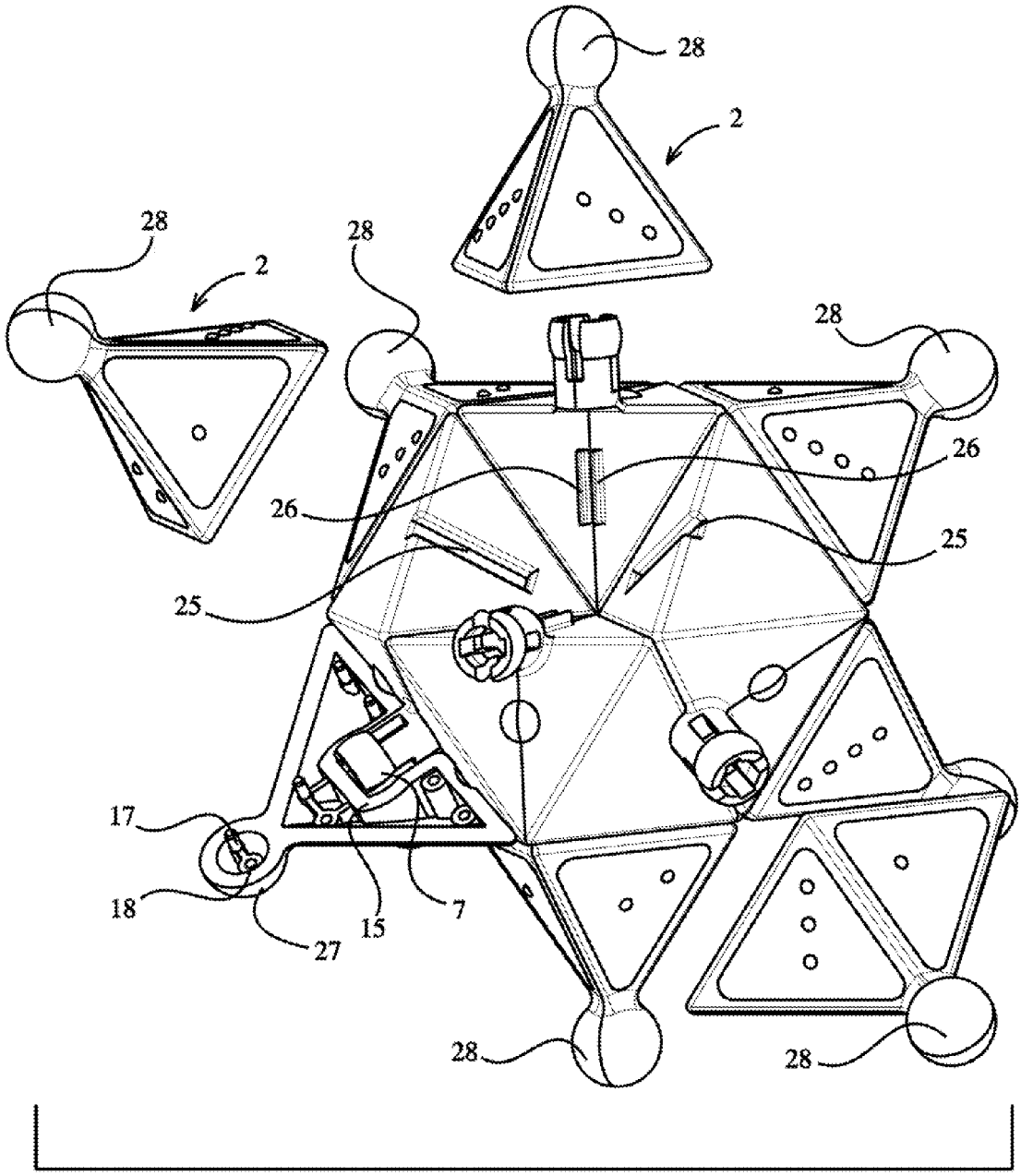
FIG. 31 is an exploded perspective view showing a stellated icosahedron puzzle, having grips and u-shaped groove provisions, with not installed front pyramid assemblies and front octahedron assembly, one left side and one top pyramid assemblies coming to be inserted into octahedron assemblies pivot shafts and one pyramid assembly without half pyramid mating part on the bottom left side of octahedron pivot shaft.

These formations 25 and 26 can help to provide easy and secure attachment and detachment of all six octahedron assemblies 1 between themselves in puzzle assembly and help to keep octahedron assemblies 1 together much easier and more secure. Engagement is shown on FIG. 30.

Figure 26:
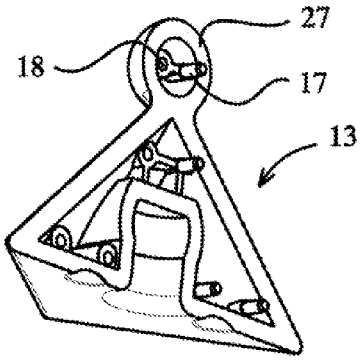
FIG. 26 is a perspective view of the pyramid part with semi sphere provision on the pyramid apex.
Figure 27A:
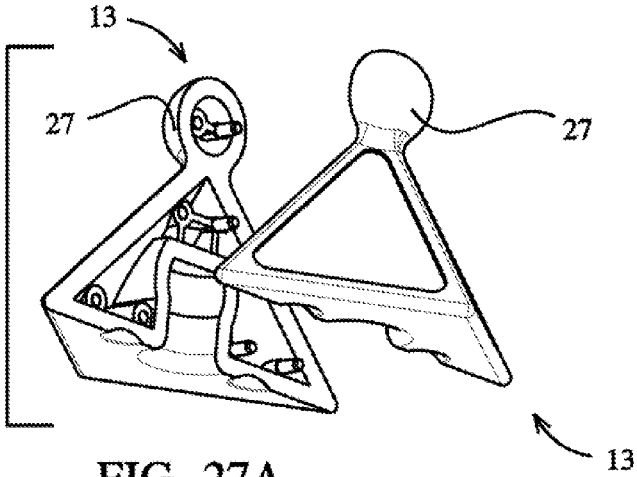
FIG. 27A is an exploded perspective view of the pyramid assembly with sphere provisions on the pyramid apex.
Figure 27B:
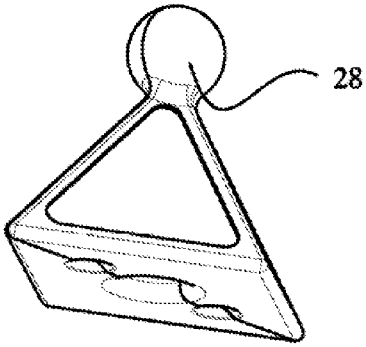
FIG. 27B is a perspective view of the pyramid assembly with sphere provisions on the pyramid apex.
Figure 27C:
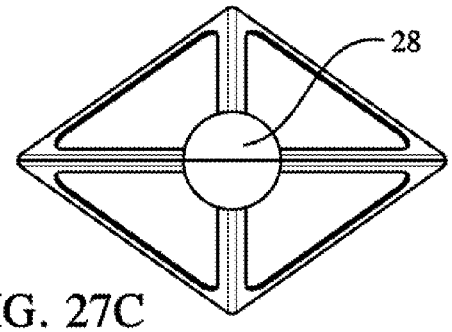
FIG. 27C is a top view of the pyramid assembly with sphere provisions on the pyramid apex shown on FIG. 27B.
Figure 27D:
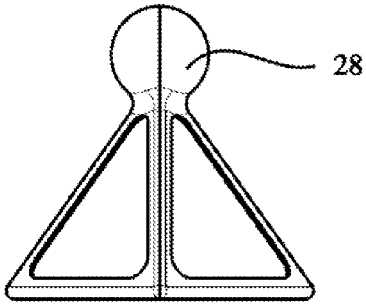
FIG. 27D is a left side view of the pyramid assembly with sphere provisions on the pyramid apex shown on FIG. 27C.
Figure 27E:
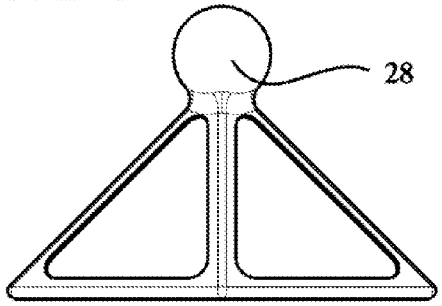
FIG. 27E is a front view of the pyramid assembly with sphere provisions on the pyramid apex shown on FIG. 27C.
Figure 27F:
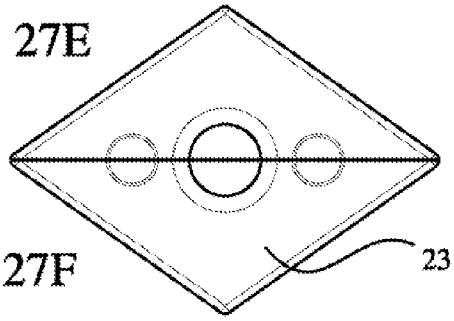
FIG. 27F is a bottom view of the pyramid assembly shown on FIG. 27E.
Figure 28A:
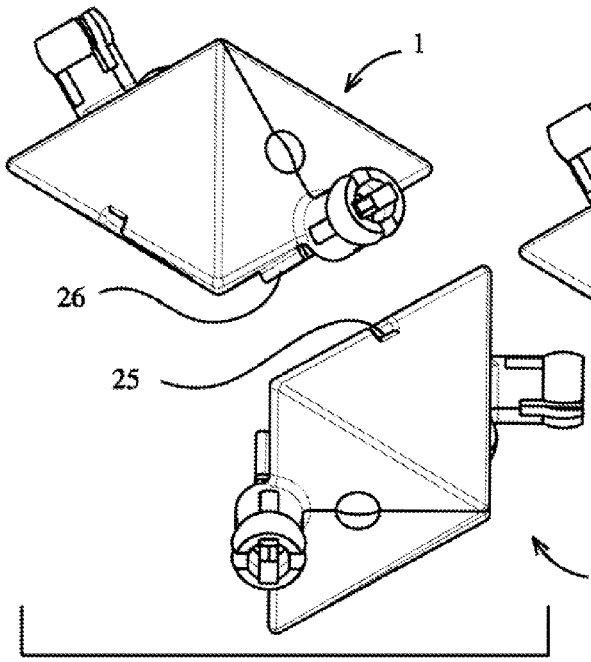
FIG. 28A is an exploded perspective view of two octahedron assemblies with grip and u-shaped groove provisions coming together.
Figure 28B:
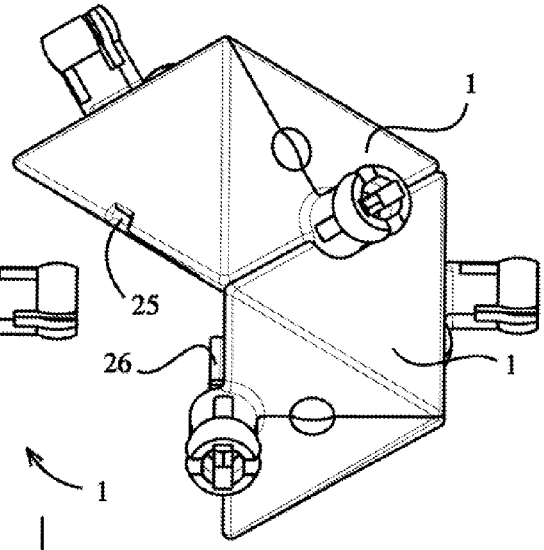
FIG. 28B is a perspective view of two octahedron assemblies with grip and u-shaped groove provisions on FIG. 28A mated together.
Figure 29:
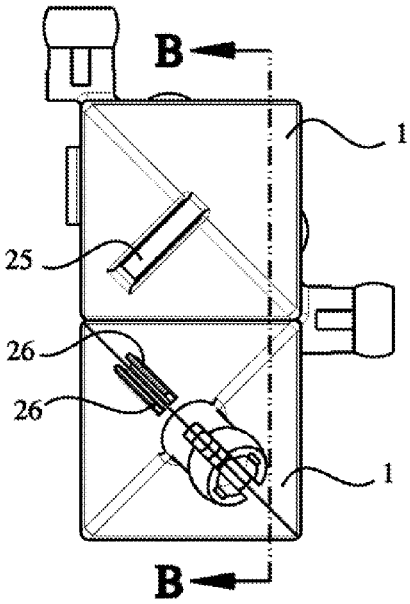
FIG. 29 is a front view of two octahedron assemblies with grip and u-shaped groove provisions on FIG. 28B.

For easy repeatable attachments and detachments of pyramid assemblies 2 each pyramid part 13 can have, on pyramid apex, hollow semi spheres 27 with symmetrically locating pins 17 on one side and pin holes 18 on another side with ensuring press-fit engagement, shown on FIGS. 26 and 27A. In pyramid assembly 2 these semi spheres 27 form full spheres 28, which serve as convenient handles, shown on FIGS. 27B-27E and 31.

The inventive puzzle operates in the following manner.

Puzzle assembly process starts with mating together two octahedron assemblies 1, shown on FIGS. 7A and 7B.

Next step in assembly process is shown on FIGS. 8A and 8B where third octahedron assembly 1 is mating together with previously assembled two octahedron assemblies 1.

Following similar steps with four, five and six octahedron assemblies 1 are shown on FIGS. 9A-11B. Player keeps all pieces together in his hands.

Figure 12A:
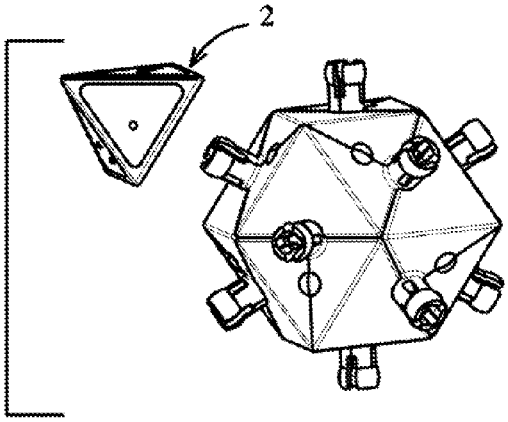
FIG. 12A is an exploded perspective view of six octahedron assemblies mated together and one pyramid assembly with label inserts coming to be inserted into octahedron pivot shaft.
Figure 12B:
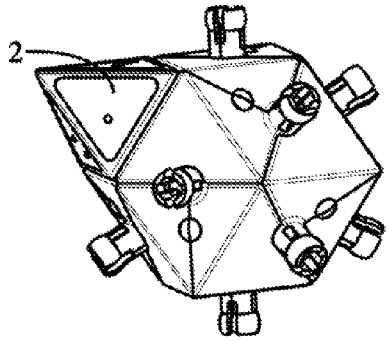
FIG. 12B is a perspective view of six octahedron assemblies and one pyramid assembly with label inserts on FIG. 12B mated together.

Next step is to install pyramid assemblies 2, shown on FIGS. 12A and 12B.

Figure 13:
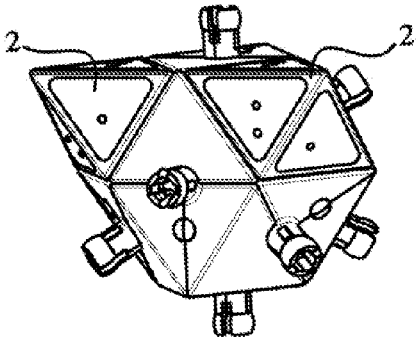
FIG. 13 is a perspective view of six octahedron assemblies and two pyramid assemblies with label inserts mated together.
Figure 14:
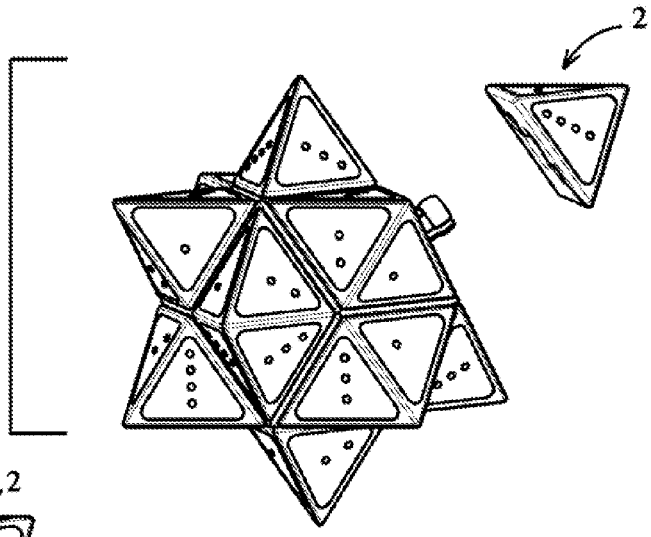
FIG. 14 is an exploded perspective view of six mated together octahedron assemblies and pyramid assemblies with label inserts mated together; last pyramid assembly coming to be inserted into octahedron pivot shaft.

Continuation of the same installation steps of all pyramid assemblies 2 into puzzle is shown on FIGS. 13 and 14.

Figure 15:
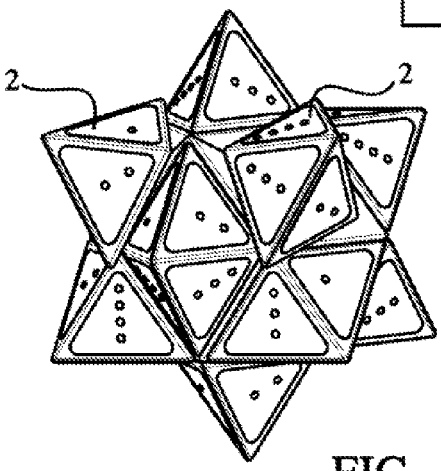
FIG. 15 is a perspective view of assembled stellated icosahedron puzzle with two pyramid assemblies rotating around octahedron pivot shafts.

The goal is not only to assemble puzzle into stellated icosahedron, but to locate all pyramid assemblies 2 with label inserts 21 with the same indexes 22 (or the same colors, numbers, letters) close to each other around entire puzzle. For this step, pyramid assemblies 2 can be rotated and reoriented as shown on FIG. 15, detached and reattached to the new position on octahedron assembly 1 as shown on FIGS. 14 and 21.

Another way how to assemble icosahedron puzzle is shown on FIGS. 16A-20.

Figure 16A:
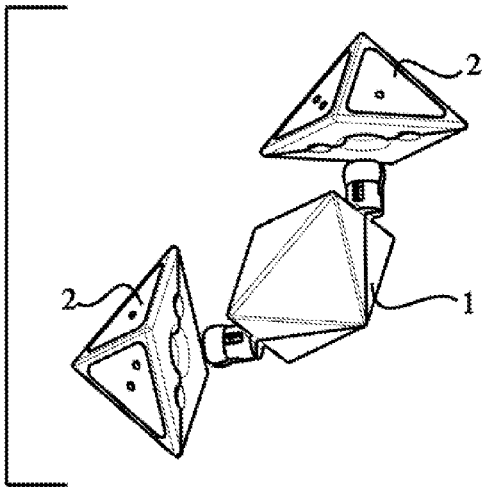
FIG. 16A is an exploded perspective view of one core subassembly in which two pyramid assemblies coming to be inserted into two octahedron assembly pivot shafts.
Figure 16B:
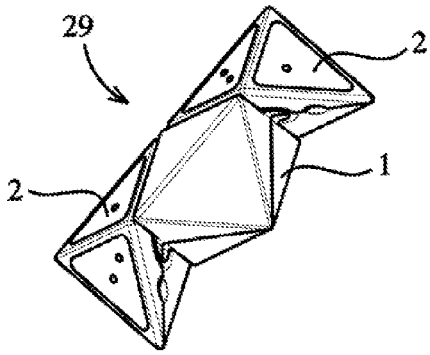
FIG. 16B is a perspective view of one core subassembly with two pyramid assemblies on FIG. 16A mated together with one octahedron assembly.

Following this way, first step is to assemble together two pyramid assemblies 2 with one octahedron assembly 1 into core subassembly 29 as shown on FIGS. 16A and 16B.

Figure 17A:
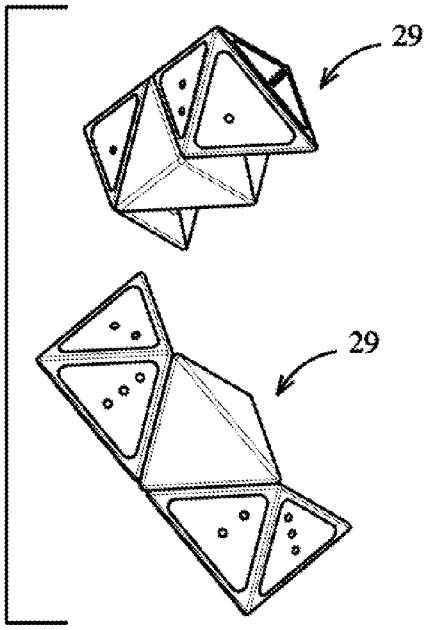
FIG. 17A is an exploded perspective view of two core subassemblies on FIG. 16B coming to be mated together.
Figure 17B:
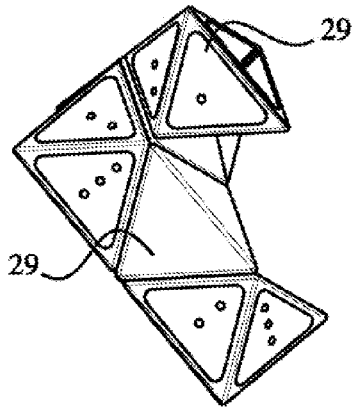
FIG. 17B is a perspective view of two core subassemblies on FIG. 17A mated together.

Second step is to assemble two core subassemblies 29 together as shown on FIGS. 17A and 17B.

Figure 18A:
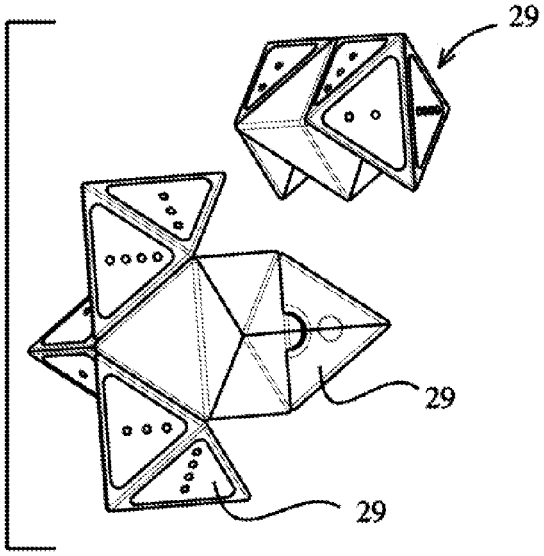
FIG. 18A is an exploded perspective view of three core subassemblies on FIG. 16B coming to be mated together.
Figure 18B:
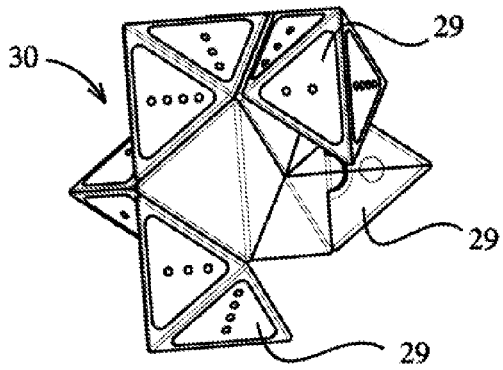
FIG. 18B is a perspective view of three core subassemblies on FIG. 18A mated together.

Third step is to assemble another core subassembly 29 with previously assembled two core subassemblies 29 into large subassembly 30 as shown on FIGS. 18A and 18B.

Figure 19:
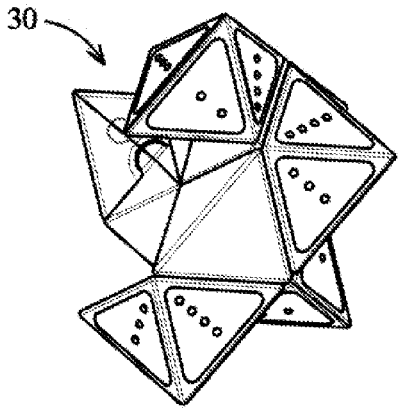
FIG. 19 is a perspective view of second set of three core subassemblies shown on FIG. 18B mated together.

First, second and third steps should be repeated one more time to create second large subassembly 30 shown on FIG. 19.

It should be admitted that player has to keep all assembled subassemblies in his hands before the final stellated icosahedron puzzle is completely assembled into one piece.

Figure 20:
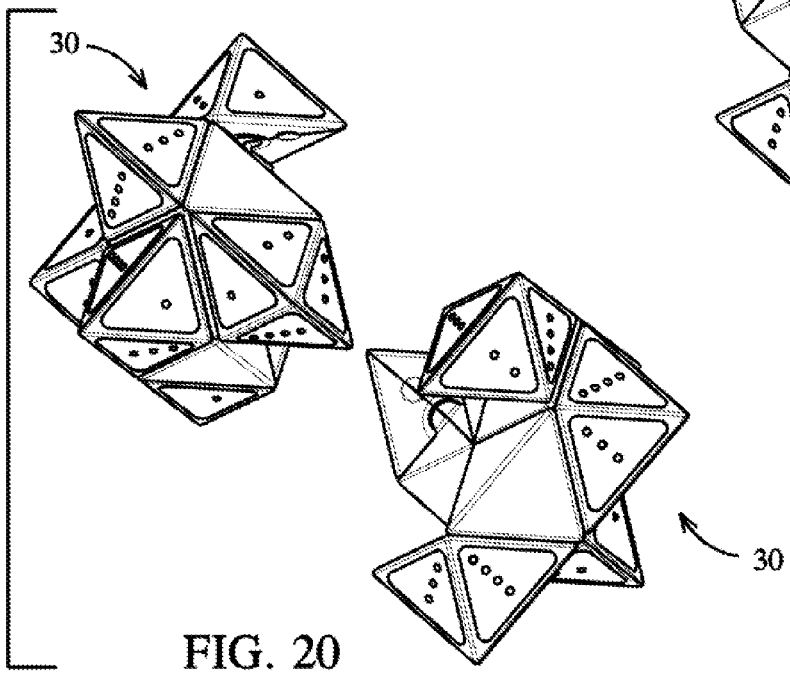
FIG. 20 is an exploded perspective view of two sets of three and three core subassemblies shown on FIG. 18B and FIG. 19 coming to be mated together.
Figure 21:
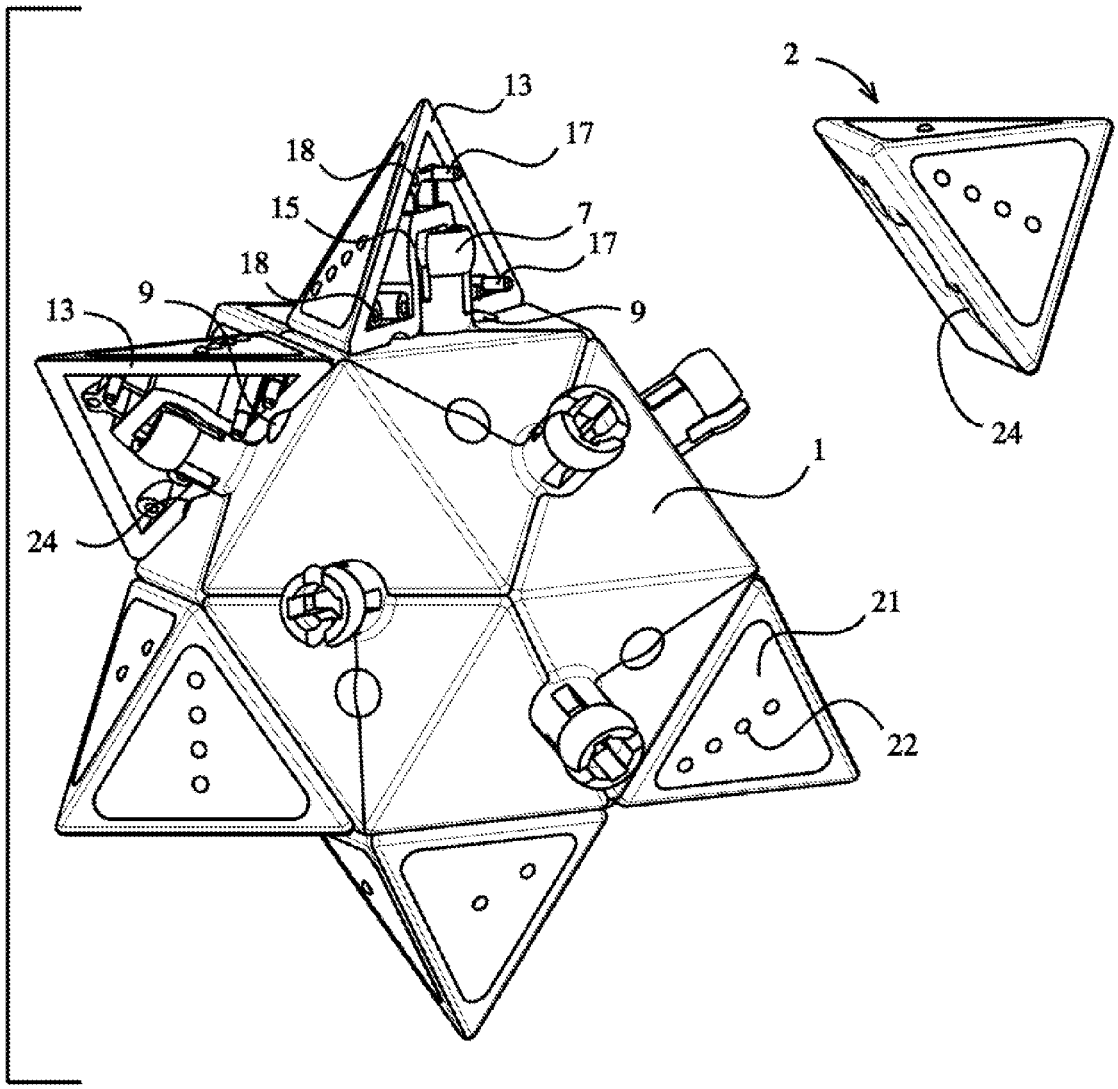
FIG. 21 is an exploded perspective view showing a stellated icosahedron puzzle with not installed three front pyramid assemblies, one right side pyramid assembly coming to be mated with octahedron assembly and two pyramid assemblies without half pyramid mating parts on the top and top left side of octahedron pivot shafts.
Figure 22A:
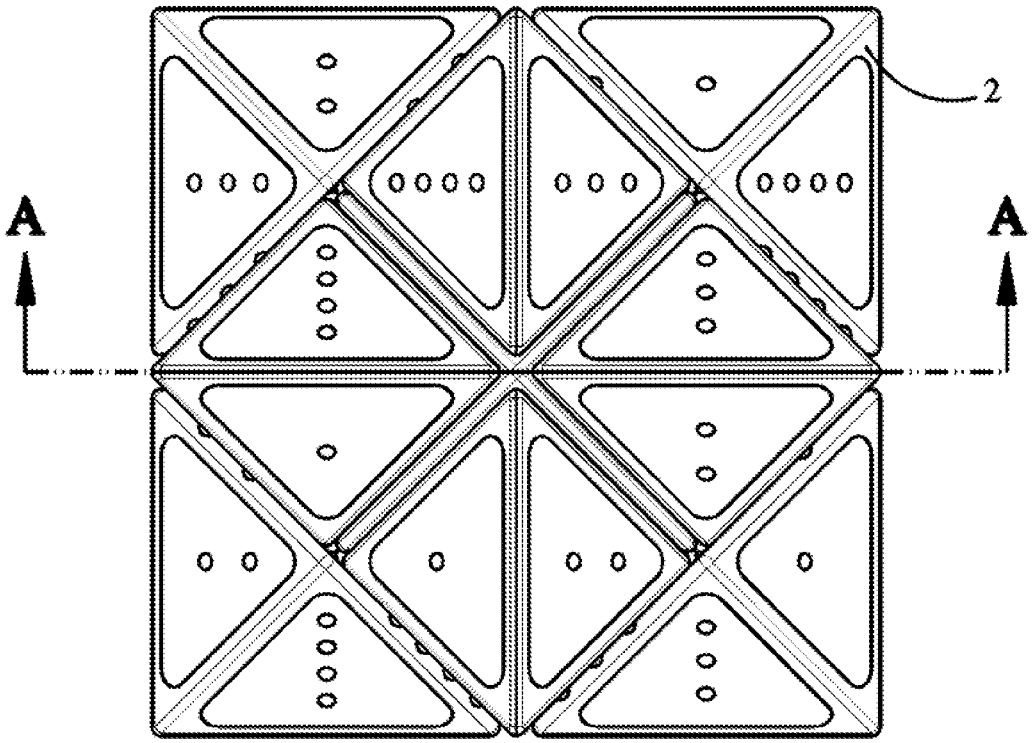
FIG. 22A is a top view of a stellated icosahedron puzzle on FIG. 1.
Figure 22B:
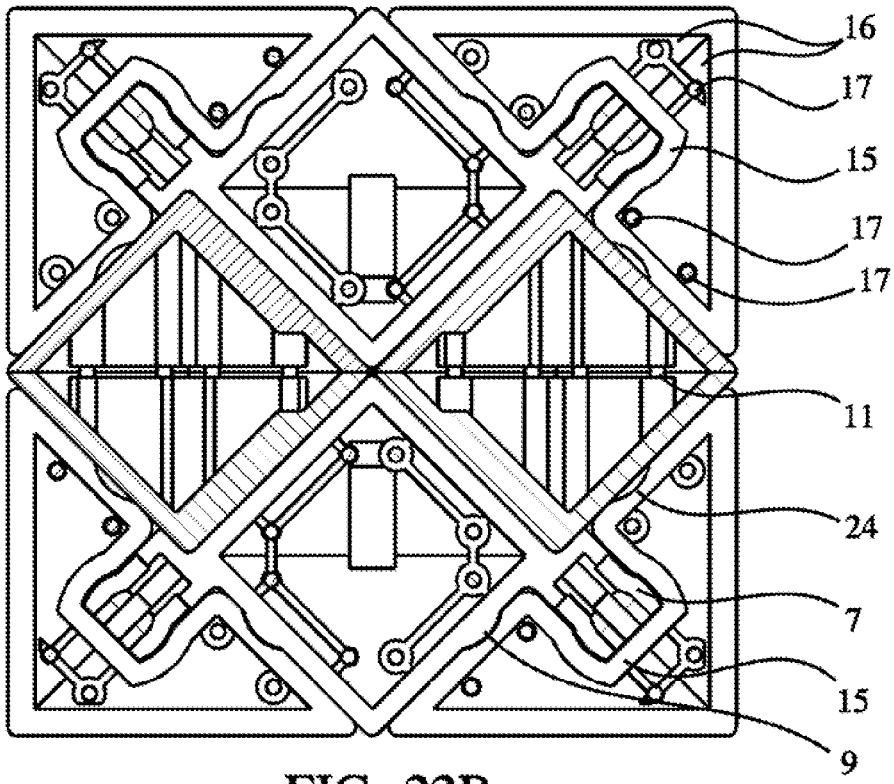
FIG. 22B is a sectional front view of a stellated icosahedron puzzle on FIG. 22A.
Figure 23:
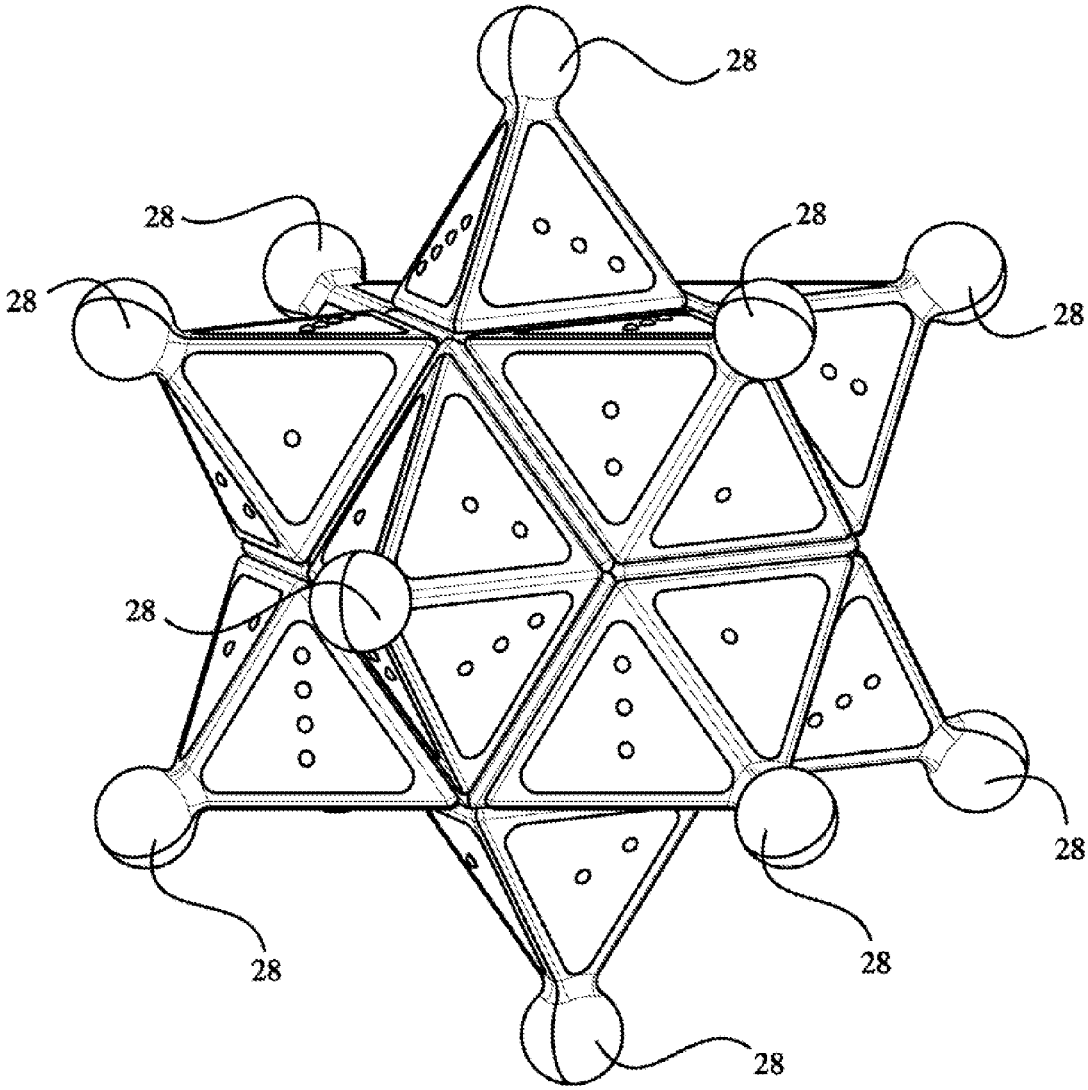
FIG. 23 is a view showing a stellated icosahedron puzzle with sphere provisions on each pyramid assembly apex in a perspective view in accordance with the present invention.
Figure 24A:
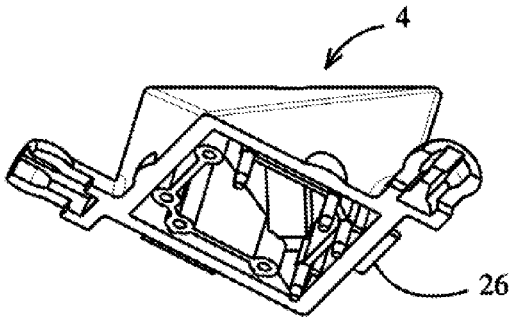
FIG. 24A is a perspective front view of the octahedron part showing grip provisions.
Figure 24B:
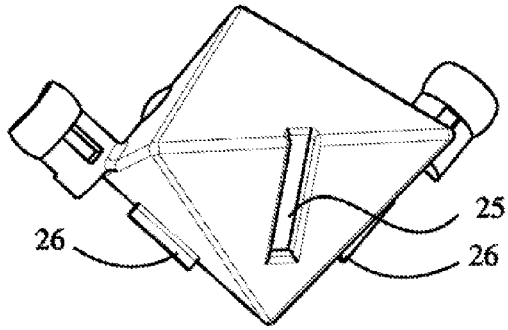
FIG. 24B is a perspective back view of the octahedron part showing grip and u-shaped groove provisions.
Figure 24C:
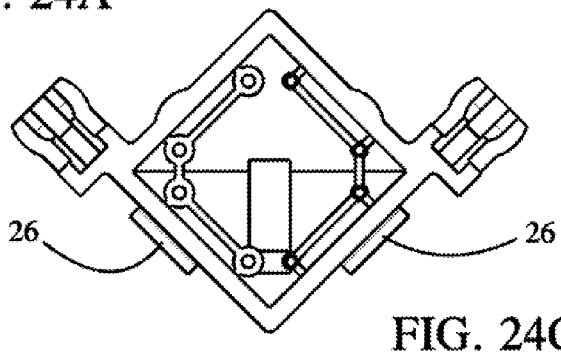
FIG. 24C is a front view of the octahedron part on FIG. 24A showing grip provisions.
Figure 24D:
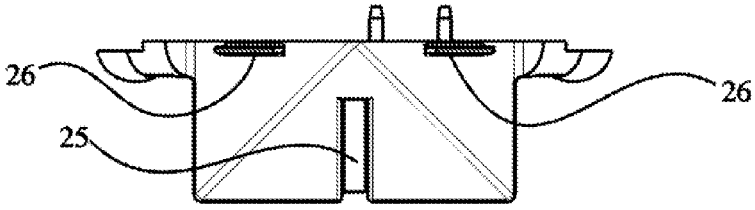
FIG. 24D is a bottom view of the octahedron part on FIG. 24C showing grip and u-shaped groove provisions.
Figure 24E:
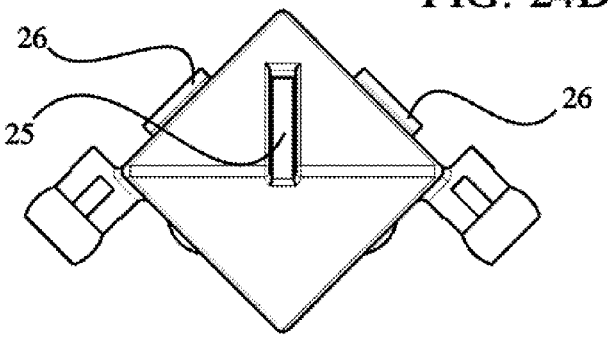
FIG. 24E is a back view of the octahedron part on FIG. 24C showing grip and u-shaped groove provisions.

Finally, last step is to clamp together two large subassemblies 30 into stellated icosahedron puzzle as shown in FIGS. 1, 20 and 23.

As mentioned before, for convenient and more secure assembly all parts into puzzle octahedron parts 4 can have u-shaped groove formations 25 and grip formations 26; pyramid parts 13 can have semi spheres 27.

The invention claimed is:

1. A stellated icosahedron puzzle which is assembled of several parts, comprising a plurality of assemblies forming together in an assembled condition a stellated icosahedron, said assemblies including six mated together hollow octahedron assemblies and twelve hollow pyramid assemblies located on said hollow octahedron assemblies and rotatable around each of said octahedron assemblies via pivot shafts of said octahedron assemblies and stoppable every 180° of rotation, said pyramid assemblies being independently attachable to and detachable from each of said pivot shafts, wherein each of said octahedron assemblies is composed of two identical hollow semi-octahedron parts, wherein each of said octahedron parts has inside surfaces provided with pins and symmetrically located pin holes engaging with one another and ensuring a press-fit engagement of two of said octahedron parts into one of said octahedron assemblies.

2. A stellated icosahedron puzzle which is assembled of several parts, comprising a plurality of assemblies forming together in an assembled condition a stellated icosahedron, said assemblies including six mated together hollow octahedron assemblies and twelve hollow pyramid assemblies located on said hollow octahedron assemblies and rotatable around each of said octahedron assemblies via pivot shafts of said octahedron assemblies and stoppable every 180° of rotation, said pyramid assemblies being independently attachable to and detachable from each of said pivot shafts, wherein each of said pyramid assemblies includes two identical hollow semi-pyramid parts each having a cut with a domed top formed for said pivot shaft, and also on an inner surface protruding pins and symmetrically located pin holes ensuring a press-fit engagement of two said pyramid parts to form one of said pyramid assemblies.

3. A stellated icosahedron puzzle as defined in claim 2, wherein each of said octahedron assemblies is composed of two identical hollow semi-octahedron parts.

4. A stellated icosahedron puzzle as defined in claim 3, wherein each of said hollow semi-octahedron parts has two halves of said hollow pivot shaft, symmetrically located on two top surfaces of said octahedron part and half-way protruding outwardly of the latter.

5. A stellated icosahedron puzzle as defined in claim 4, wherein each of said half of said hollow pivot shaft in said octahedron assembly form a full said pivot shaft and has a top domed end with elasticity-imparting gaps to accommodate insertion of a respective one of said pyramid assemblies to provide a robust and easy attachment of the latter.

6. A stellated icosahedron puzzle as defined in claim 2, wherein each of said top surfaces of said octahedron part has bumps providing stepping of said pyramid assembly every 180° of its rotation.

7. A stellated icosahedron puzzle as defined in claim 2, wherein each of said pyramid parts has recesses for locating label inserts which are attached by one of pressing or gluing into the recess.

8. A stellated icosahedron puzzle as defined in claim 7, wherein said labels have different elements selected from the group consisting of colors, numbers, and indexes.

9. A stellated icosahedron puzzle as defined in claim 6, wherein said pyramid parts have on an outside bottom surface two symmetrical cutouts interacting with said bumps of said octahedron assembly for fixing rotation of said pyramid assembly every 180° of rotation.

10. A stellated icosahedron puzzle as defined in claim 2, wherein said octahedron part has two bottom outside surfaces provided with grip provisions and one middle bottom outside surface with central u-groove provision for easy and secure attachments and detachments of octahedron assemblies with each other.

11. A stellated icosahedron puzzle which is assembled of several parts, comprising a plurality of assemblies forming together in an assembled condition a stellated icosahedron, said assemblies including six mated together hollow octahedron assemblies and twelve hollow pyramid assemblies located on said hollow octahedron assemblies and rotatable around each of said octahedron assemblies via pivot shafts of said octahedron assemblies and stoppable every 180° of rotation, said pyramid assemblies being independently attachable to and detachable from each of said pivot shafts, wherein each of said pyramid parts has on its apex hollow semi-spheres with symmetrically located pins on one side and pin holes on another side, so that said semi-spheres together form full spheres serving as handles for easy and convenient pyramid attachments to and detachments from octahedron surfaces.

* * * * *